US007642509B2

(12) United States Patent
Hartmer et al.

(10) Patent No.: US 7,642,509 B2
(45) Date of Patent: Jan. 5, 2010

(54) TOP-DOWN PROTEIN ANALYSIS IN MASS SPECTROMETERS WITH ION TRAPS

(75) Inventors: Ralf Hartmer, Hamburg (DE); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 252 days.

(21) Appl. No.: 11/874,372

(22) Filed: Oct. 18, 2007

(65) Prior Publication Data

US 2008/0093547 A1 Apr. 24, 2008

(30) Foreign Application Priority Data

Oct. 24, 2006 (DE) ..... 10 2006 050 021

(51) Int. Cl.
*H01J 49/26* (2006.01)

(52) U.S. Cl. ..... 250/282; 250/281; 250/283; 250/293

(58) Field of Classification Search ..... 250/281, 250/282, 283, 293
See application file for complete search history.

(56) References Cited

U.S. PATENT DOCUMENTS

| | | | | |
|---|---|---|---|---|
| 6,188,064 | B1 | 2/2001 | Koster | |
| 6,674,067 | B2 | 1/2004 | Grosshans et al. | |
| 7,064,317 | B2 | 6/2006 | McLuckey | |
| 7,456,397 | B2 * | 11/2008 | Hartmer et al. | 250/292 |
| 7,476,853 | B2 * | 1/2009 | Zubarev et al. | 250/292 |
| 2005/0199804 | A1 * | 9/2005 | Hunt et al. | 250/290 |
| 2006/0255261 | A1 * | 11/2006 | Whitehouse et al. | 250/288 |
| 2008/0093546 | A1 * | 4/2008 | Hartmer | 250/282 |

FOREIGN PATENT DOCUMENTS

| | | | |
|---|---|---|---|
| DE | 10 2005 005 743 | A1 | 10/2006 |
| EP | 1 341 295 | A2 | 8/2003 |
| WO | WO 02/101 78 | A1 | 12/2002 |
| WO | WO 2006/042187 | A2 | 4/2006 |

OTHER PUBLICATIONS

Hunt, Donald F.; "Comparative Analysis of of Post-Translationally Modified Proteins and Peptides by Mass Spectrometry: New Technology (Electron Transfer Dissociation) and Applications in the Study of Cell Migration, the Histone Code and Cancer Vaccine Development"; 17th International Mass Spectrometry Conference; Aug. 27-Sep. 1, 2006; Prague, Abstract; 2 pages.

* cited by examiner

*Primary Examiner*—Nikita Wells
*Assistant Examiner*—Michael J Logie
(74) *Attorney, Agent, or Firm*—Law Offices of Paul E. Kudirka

(57) ABSTRACT

Proteins with a molecular mass in the range from approximately 5 to 100 kilodaltons are structurally analyzed without prior enzymatic digestion to small peptides in a mass spectrometer that operates with an ion trap. The proteins are ionized by electrospraying or similar processes to create highly charged analyte ions, which are then introduced into the ion trap and subjected to fragmentation and partial deprotonation in either order. The fragmentation may be ergodic or electron-induced. The result remaining in the ion trap is an evenly distributed mixture of fragment ions having between one and n charges, where n is a number between three and about eight. A mass spectrum is recorded from this mixture of fragment ions, which spectrum demonstrates a sequence coverage that far exceeds the mass range of the mass analyzer for singly charged ions.

18 Claims, 4 Drawing Sheets

TOP-DOWN PROTEIN ANALYSIS IN MASS SPECTROMETERS WITH ION TRAPS

BACKGROUND

The invention relates to the structural analysis of proteins in the molecular mass range from approximately 5 to 100 kilodaltons, without prior enzymatic digestion to small peptides, in mass spectrometers that operate with ion traps.

Proteins and peptides both consist of chains of amino acids; the difference between peptides and proteins consists only in the length of the chains, but there is no sharply defined distinction. Proteins consist of chains with many more than 20 linked amino acids, whereas peptides generally consist of fewer. When we speak here of proteins, chains with around 40 or more amino acids are meant, with molecular masses greater than around 5 kilodaltons. The majority of proteins have a molecular mass below 100 kilodaltons; these "medium-mass proteins" of 5 to 100 kilodaltons are the primary focus of interest here, although some other interesting proteins, such as antibodies, have molecular masses between 100 and 1,000 kilodaltons. There are even some proteins with masses of more than a megadalton. Until now, the very large proteins have scarcely been accessible to mass spectrometric top-down analysis without prior enzymatic digestion. There are, however, enzymes whose cleavages only occur at rarely found sequence patterns, and which generate large digestion proteins with molecular masses above 5 kilodaltons. These large digestion proteins will also be considered here as "medium-mass proteins". Such enzymes also permit piecewise top-down analysis of very large proteins.

The mass spectrometric structural analysis of heavier proteins, which essentially consists in analyzing the sequence of amino acids, but also includes the identification of their modifications, starts conventionally with enzymatic digestion of the proteins to create relatively light digestion peptides, in order to produce molecular sizes that can effectively be measured in a mass spectrometer. The most frequently applied technique of trypsin digestion, for instance, yields digestion peptides with an average length of 10 amino acids, as trypsin exclusively cleaves the C-terminal peptide bonds of the amino acids arginine and lysine. Other enzymes that only cleave the peptide bond specifically at one amino acid yield digestion peptides with an average length of twenty amino acids. The digestion peptides are then fed to a tandem mass spectrometer, either as an unseparated mixture, or following chromatographic separation. Measurement of the fragment ion spectra of the individual digestion peptides now provides partial segments from the sequence. These are usually sufficient to perform identification in protein sequence databases, using suitable search engines, and also to identify some of the modifications.

Unfortunately, this method also has disadvantages. Generally only between 50 and 70 percent of the digestion peptides can be found and measured in the mass spectrometer. No information is yielded regarding the modifications of the lost digestion peptides. The molecular mass of the undigested protein cannot be determined. The information about the sequence of digestion peptides in the original protein is lost. If the digestion acts on two or more proteins that cannot be separated, it is not possible to assign the digestion peptides to the specific proteins. For this reason methods have been sought for some time, by which the protein as a whole can be subjected to mass spectrometric analysis without prior enzymatic digestion, and which permits determination of the longest possible sequence segments from the original protein molecules. Such methods have so far only been developed for very expensive ion cyclotron resonance mass spectrometers (ICR-MS). They have become known as "top-down analyses". Top-down analyses transfer the process of dividing the proteins into smaller units to the mass spectrometer; they require appropriate ionization and fragmentation methods for the medium-sized proteins and, as shown below, of further measures for equalizing the very complex fragment ion spectra that result.

Matrix assisted laser desorption (MALDI) and electrospraying (ESI) are predominantly used nowadays for ionizing proteins and other biomolecules. MALDI almost exclusively yields singly charged ions, which are very unfavorable for fragmentation because they are difficult to fragment, and because their fragment ions only yield small segments of the amino acid sequence, with large gaps. The complex process known as MALDI yields both a non-ergodic spontaneous fragmentation in the laser plasma (ISD="in-source decay") as well as an ergodic fragmentation through the metastable decay of excited analyte ions (LID="laser induced decomposition", also known as PSD="post-source decay"), but both can only be used for measurement in highly specialized MALDI time-of-flight mass spectrometers, and will not be considered further here.

If multiply charged analyte ions are to be generated for mass spectrometric analysis of biomolecules, in particular for an analysis that includes fragmentation, the usual method of generating molecular ions is electrospray ionization (ESI), which creates ions at atmospheric pressure outside the mass spectrometer. These ions are then guided through inlet systems of a known type into the mass spectrometer's vacuum system, and on into mass spectrometric analyzer, e.g., an ion trap. There the molecules are accessible to further manipulations such as fragmentation.

Electrospray ionization produces almost no fragment ions, and the ions are substantially those of the protonated molecules; due to their multiple protonation their mass is a corresponding number of Daltons greater than the neutral molecules, and they are therefore frequently referred to as "pseudomolecular ions". Multiple protonation from electrospraying usually results in multiply charged ions of the molecules: doubly and triply charged ions for smaller molecules such as peptides, while for larger biomolecules, such as proteins with molecular masses in the range between 5 and 100 kilodaltons, the ions may carry up to ten or even a hundred charges. If possible, fragmentation is carried out on protein ions with double to quadruple charges, as these have a very high yield of fragment ions and deliver easily evaluated fragment ion spectra. In the case of medium-sized proteins, however, molecular ions with two to four charges only occur with vanishingly small intensities, and cannot therefore be used for fragmentation.

The spectra of the fragment ions are also known as "daughter ion spectra" of the parent ions concerned. It is also possible to measure the "granddaughter spectra", which are the fragment ion spectra of selected daughter ions. The structures of the fragmented ions can be read from these daughter (and granddaughter) ion spectra; for instance, it is possible (although difficult for many fragmentation methods) to determine at least parts of the sequence of amino acids in a peptide or protein from these spectra.

Two different types of ion traps exist nowadays, frequently referred to as "Penning ion traps" and "Paul ion traps". The Penning ion traps hold the ions radially in a strong magnetic field, and axially in an electric trapping potential. They are used in ion cyclotron resonance mass spectrometers (ICR-MS). Modern ICR-MS nearly all use very expensive superconducting magnet coils, cooled in liquid helium, to generate magnetic fields with very high strengths of around 7 to 15 Tesla. Fewer than one thousand such instruments have been built. Nowadays they are predominantly also equipped with RF ion traps to permit collision-induced dissociation, or other manipulations of the ions.

Paul ion traps hold the ions using inhomogeneous RF fields. These create what are known as "pseudopotentials", which form a storage well in which both positive and negative ions can be trapped. In "three-dimensional" (3D) RF ion traps, the pseudopotential rises in all three spatial directions, whereas they rise only in two spatial directions in "two-dimensional" (2D) RF ion traps. In two-dimensional ion traps, the ions must be held in the third spatial direction by other techniques, usually by DC potentials. In the potential wells of the RF ion traps, the ions can carry out what is referred to as "secular oscillations". The oscillation frequency is inversely proportional to their mass-to-charge ratio m/z. Filling the trap with a collision gas damps the secular oscillations, and the ions accumulate as a cloud at the minimum of the potential well. The RF ion traps are very cheap in relation to their performance, and have therefore become extremely widespread, with many thousands of instruments in use. As will be explained in more detail below, Paul ion traps can be designed as what are known as 2D ion traps or as 3D ion traps.

Mass spectrometers with RF ion traps have features that make them interesting for many types of analysis. In particular, they can isolate selected types of ions (the parent ions) in the ion trap and fragment them using a variety of methods. The isolation of one type of ion means that all the uninteresting ion types are removed from the ion trap by strong resonant excitation of their secular oscillations or by other measures, so that only the parent ions remain. These can then be fragmented, yielding fragment ion spectra uncontaminated by fragment ions of other substances.

RF ion traps have one special feature that can sometimes be disadvantageous. They possess a "lower mass threshold" for ion storage. Ions whose mass-to-charge ratio m/z is below this mass threshold cannot be stored in the ion trap. These light ions can be accelerated so much in a single half-wave of the RF voltage that they collide with the electrodes and are destroyed. The lower mass threshold rises in proportion to the RF voltage.

Nowadays, two fundamentally different types of fragmentation are available in the different types of ion traps: "ergodic" fragmentation and "electron-induced" fragmentation.

"Ergodic" fragmentation of analyte ions refers here to a fragmentation in which a sufficiently large excess of internal energy in the analyte ions leads to fragmentation. This excess of inner energy can, for instance, be generated by a large number of collisions between the analyte ions and a collision gas, or by the absorption of a large number of photons from infrared radiation.

According to the "ergodic hypothesis" originally formulated by Boltzmann, in a closed system such as that of a complex molecular analyte ion, when sufficient energy is present, then every state that can be achieved with this energy will in fact be achieved over the course of time. This ergodic hypothesis has since been proved mathematically, and is therefore no longer strictly a hypothesis. Since the fragmentation represents a possible state, that is the generation of two smaller particles from the analyte ion, the fragmentation will occur at some time. The absorption of energy temporarily creates "metastable" analyte ions, which then at some point in time decompose. The decomposition itself is characterized by a "half life time" which, however, depends on the quantity of excess inner energy and cannot be quantified because the amount of excess energy is unknown.

The probability that a given bond will experience an ergodic cleavage depends on its binding energy. The weakest bonds in the analyte ion have the highest probability to be cleaved. In proteins, the weakest bonds are those known as "peptide bonds" between the amino acids, leading to fragments in the so called b and y series, which occur partly as fragment ions and partly as neutral particles. Since the different peptide bonds between different amino acids have somewhat different binding energies, some peptide bonds in the analyte ion are cleaved with a greater probability and others with a lower probability. As a result, not all the fragment ions created by cleaving peptide bonds have the same intensity in the fragment ion spectrum. Non-peptide bonds within the chain of amino acids are cleaved so rarely that the resulting particles are not found in measurable quantities. Modifying side chains, however, like phosphorylations or glycosylations, are regularly split off.

The conventional method of fragmenting analyte ions in RF ion traps is ergodic fragmentation through collisions, in which the excess of internal energy is introduced to the analyte ions through numerous collisions with a collision gas in the RF ion trap. To enable the collisions to pump energy into the analyte ions, they must occur with a certain minimum collision energy. The collision energy is conventionally created by weak, resonant excitation of the secular ion oscillations of the parent ions by means of a dipolar alternating voltage. This leads to a large number of collisions with the collision gas without removing the ions from the RF ion trap. The ions can accumulate energy through these collisions, finally resulting in ergodic decomposition of the ions and the creation of fragment ions. Until a few years ago, this collision-induced dissociation (CID) was the only known method of fragmentation in RF ion traps.

Collision-induced dissociation in RF ion traps also has disadvantages, however. For larger analyte ions, for example, it is necessary to use a very high RF voltage for storing the ions in order to create sufficiently strong collision conditions. As a result, the RF ion trap has a very high lower mass threshold. Ions with a mass below the mass threshold can no longer be stored, and are lost. The fragment ion spectrum therefore only begins at a mass that is around one third of the mass m/z of the analyte ion; the fragment ion spectrum no longer yields any information about the light fragment ions, as those ions have been lost. Multiply charged heavy analyte ions often have a low mass-to-charge ratio m/z of only around 500 to 1,000 Daltons because of the large number of protons; these analyte ions cannot be fragmented at all, as the RF voltage cannot be set high enough to generate sufficiently energetic collisions to pump energy into the ions.

To also store very small fragment ions (in particular what are known as the immonium ions, created by the internal fragmentation of fragment ions) by means of collision-induced dissociation, special methods have recently become known that make use of the slow, metastable decay of the ions by the ergodic fragmentation process. The method is described in patent DE 10 2005 025 497 B4 (A. Brekenfeld; equivalent to patent application publication GB 2 428 515 A).

Collision-induced dissociation in ion cyclotron resonance mass spectrometers (ICR-MS) is very difficult, as these spectrometers only work well at optimal ultra-high vacuums below 10-9 hectopascal. Nevertheless, equipment for collision-induced dissociation is available for the ion traps of these devices. An other kind of ergodic fragmentation, however, was introduced here at a very early stage: infrared multiphoton dissociation (IRMPD). With this method, the internal energy of the analyte ions is increased through the absorption of a large number of infrared photons. Carbon dioxide lasers are usually used here to generate sufficiently strong infrared radiation. IRMPD equipment for ICR-MS is commercially manufactured and marketed.

Document WO 02/101 787 A1 (S. A. Hofstadler and J. J. Drader) has published that infrared multiphoton dissociation (IRMPD) can also be used in RF ion traps. The infrared radiation is introduced into a three-dimensional RF ion trap in a simple manner through an evacuated hollow fiber with an optically reflective internal coating. This makes a further process for ergodic fragmentation available in RF ion traps. This type of fragmentation is very favorable, as it can be carried out at low RF voltages; the small fragment ions are then also stored. However, there are not yet any commercially marketed RF ion trap mass spectrometers featuring this method of fragmentation.

We turn now to electron-induced fragmentation methods. About ten years ago, an entirely new method of fragmenting protein ions was discovered: non-ergodic fragmentation, induced by the capture of low-energy electrons (ECD="electron capture dissociation"). Through the direct neutralization of an associated proton, which is then lost as a radical hydrogen atom, the potential balance of the protein ion is disturbed in such a way that appropriate repositionings induce a cleavage of the amino acid chain. The cleavage does not occur at the peptide bonds, but at neighboring bonds, leading to what are known as c and z fragment ions.

It is particularly easy to carry out this type of fragmentation in ICR mass spectrometers, as the low-energy electrons from a thermionic cathode can simply be guided along the magnetic force lines to the stored cloud of analyte ions. ECD fragmentation can only be applied to RF ion traps with some difficulty, as the strong RF fields do not efficiently allow the electrons to reach the cloud of analyte ions with low-energy. There are, nevertheless, a variety of approaches to ECD fragmentation in RF ion traps, but each of them requires more costly equipment.

Recently, a method was published for the fragmentation of ions in RF ion traps that delivers the same kind of fragmentations as electron capture dissociation (ECD) but by means of different reactions: electron transfer dissociation (ETD). This can be easily done in ion traps by introducing suitable negative ions in addition to the stored analyte ions. Methods of this type have been described in the published patent applications DE 10 2005 004 324.0 (R. Hartmer and A. Brekenfeld) and US 2005/0199804 A1 (D. F. Hunt et al.). The fragment ions here (as in the case of ECD) belong to what are known as the c and z series, and are therefore very different from the fragment ions of the b and y series, which are obtained by ergodic fragmentation. The fragments in the c and z series have significant advantages for determining the amino acid sequence from the mass-spectrometric data, not least because ETD fragment ion spectra can more easily extend down to smaller masses than collision-induced fragment ion spectra.

The fragmentation of protein ions by electron transfer (ETD) in an RF ion trap is created in a very simple manner by reactions between multiply charged positive protein ions and suitable negative ions. Suitable negative ions are often radical anions, such as those of fluoranthene, fluorenone, anthracene or other polyaromatic compounds. In radical anions, the chemical valences are not saturated, which permits the easy donation of electrons in order to reach an energetically favorable non-radical form. They are generated in NCI (negative chemical ionization) ion sources, most probably by simple electron capture or by electron transfer. In principle the design of NCI ion sources is the same as for chemical ionization (CI ion sources), but they are operated in a different way in order to obtain large quantities of low-energy electrons. NCI ion sources are also referred to as electron attachment ion sources.

It has since become known that electron transfer can take place from highly excited neutral particles, for example by highly excited helium atoms from a "fast atom bombardment" (FAB) particle source (DE 10 2005 005 743 A1, R. Zubarev et al.). This type of fragmentation is abbreviated to MAID ("metastable atom induced dissociation"). Here again, the fragment ion spectra are similar to those obtained from ECD. The source of the electron appears to be irrelevant for the non-ergodic fragmentation process by neutralization of a proton by an electron. The ECD, ETD and MAID fragmentation methods can therefore all be referred to as "electron induced" fragmentation methods.

It is very easy to evaluate the fragment ion spectra if they are produced from parent ions with between two and about four charges, because fragment ions with between two and four charges can be recognized as such from the differences in mass of their isotope pattern, and because the fragment ion spectra are not too complex. It is a different situation when highly charged parent ions having, for instance, ten or thirty charges, are subjected to this fragmentation procedure. The number of different types of fragment ion is extremely high and the great majority of fragment ions are crowded in a region around the mass-to-charge ratio m/z of about 600 to 1,200 Daltons. The fragment ion spectrum is so complex that it is scarcely possible to evaluate it, particularly as the isotope patterns in the RF ion traps used as mass analyzers can no longer be resolved by mass, and therefore the level of charge cannot be established.

Larger molecules, proteins in particular, yield multiply charged ions in electrospray ion sources; as a rule of thumb, we can assume that every increase in mass by 800 to 1,000 Daltons leads to a mean increase in charge of one proton. A protein with a mass of 10,000 Daltons has therefore accepted about 10 to 12 protons at the peak of the charge distribution, but in most cases there is a broad distribution of ions with various numbers of charges, most of them being in the mass-to-charge ratio m/z range from 600 to 1,200 Daltons. Doubly or triply charged ions here occur with vanishingly small frequencies, and therefore cannot practicably be used for generating the fragment ions; for these reasons fragmentation comes up against great difficulties with protein molecules in the range of molecular masses between 5 and 100 kilodaltons, even though the highly charged analyte ions can be dissociated extremely well by electron transfer, for instance. The fragment ions created this way, in particular the heavy fragment ions, are themselves predominantly highly charged, and form the complex fragment ion spectrum described above.

It has long been known that ions with multiple charges can be converted by continued deprotonation ("charge stripping") into ions with single or low numbers of charges. This is done very easily by continued proton transfer from the ions with multiple positive charges to special kinds of negatively charged ions, most particularly to non-radical anions, which are thereby neutralized. The reaction cross-section for such a proton transfer reaction is proportional to the square of the number of proton charges on the positively charged ion; the deprotonation therefore happens very quickly for highly charged ions, while the reaction speed is sharply reduced when the ions have lower charges. If, for instance, the supply of negative reactant ions for deprotonation is stopped when singly charged ions are reached, the measurements in the mass analyzer will yield mass spectra which can easily be evaluated, as these now contain practically only the signals of singly charged ions.

For electron transfer dissociation of medium-sized proteins in ion traps, it is already known that this effect can also be applied to the fragment ions created in this way: after highly charged ions of the large protein molecules have been stored, ETD fragmentation is applied by injecting suitable radical anions; then, non-radical anions are injected for deprotonation, until almost complete reduction of the charge states down to singly charged ions has occurred. This yields mass spectra of the ETD fragment ions which can easily be evaluated. A report was presented to the "17th International Mass Spectrometry Conference", Aug. 27-Sep. 1, 2006, Prague, by Donald F. Hunt (Abstract 1.2).

A further interesting method has recently become known in the field of deprotonation of highly charged pseudomolecular ions. The highly charged pseudomolecular ions of a substance that are present with various levels of charge can be deprotonated simultaneously in an RF ion trap, and the process of deprotonation can be halted at a particular level of charge so that all the pseudomolecular ions from higher levels of charge accumulate at this particular charge level in a partially deprotonated state. To do this, it is necessary to generate gentle resonant excitation of the secular oscillations—by means of a dipolar alternating voltage—at the mass-to-charge m/z of this charge level of the pseudomolecular ions. The ions that then are in forced oscillation at this charge level are no longer able to participate in further reactions with deprotonating reactant anions, as deprotonation requires a low relative velocity of the participating particles. This method is described in U.S. Pat. No. 7,064,317 B2 (S. M. McLucky et al.).

Such a conversion of highly charged pseudomolecular ions of various charge levels to a specified level of charge brings, at the same time, a high sensitivity, as the analyte ions of all the higher charge levels accumulate with a relatively high yield at the chosen level during the deprotonation process. Yields of more than 50 percent can be achieved. Furthermore, if highly charged ions of several substances are present, it is thus possible to select only the analyte ions, as the ions of the other substances are not collected, but, if the reaction time is long enough, undergo deprotonation to the bitter end, that is until they are neutralized.

It was already explained above that an extraordinary number of fragments are formed from medium-mass, highly charged protein ions, and these also carry a wide range of numbers of charges. The majority of fragment ions appear in the mass-to-charge ratio m/z range from 600 to 1,200 Daltons. The resulting mass spectrum is, in most cases, impossible to untangle, even with the highest possible mass resolution. So many fragment ions, each with its isotope pattern, are superimposed that even the best deconvolution algorithms are not able to cope with this mixture of signals. If the RF ion traps of the mass spectrometers are also being used as mass analyzers, the position is hopeless, as they are not capable of resolving the isotope patterns of the highly charged fragment ions into the individual masses.

If, however, as is known from the prior art, the fragment ions in the ion trap are deprotonated down to a charge level of one (or at most two), it becomes possible to measure a mass spectrum for the fragment ions. This can in fact be done both with RF ion traps that are also used as mass analyzers and with other types of mass analyzers. A disadvantage, however, is that the mass spectrum is restricted to the mass analyzer's mass range for singly (or at most doubly) charged ions. This does not give good sequence coverage for medium-mass proteins.

The measurement of a mass spectrum for the fragment ions can be done with the RF ion trap itself. A range of scan methods are known for this, almost all of which are based on a rapid sequence of mass-selective ion ejections. The ejected ions are measured in an ion detector. The fragment ions can, however, also be measured in connected mass analyzers of another type. For example, combinations of RF ion traps with ion cyclotron resonance mass spectrometers, with Kingdon cells or with time-of-flight mass spectrometers are commercially available.

Three-dimensional Paul RF ion traps (3D ion traps) consist of a ring electrode and two end cap electrodes. As a general rule, the RF voltage is applied to the ring electrode, but other operating modes are possible. Both positive and negative ions can be held in the quadrupole RF field inside the ion trap for mass spectrometric analysis. The ion traps can be used as mass spectrometers by ejecting the stored ions—selected according to mass—and measuring them with secondary electron multipliers. Several different methods are known for the ion ejection, but these will not be described in any further detail here. Good commercial ion trap mass spectrometers have a mass range extending up to a mass-to-charge ratio of m/z=3,000 Daltons, and at each mass it is possible with special scan methods to resolve the isotope pattern up to ions with four charges. Ion trap mass spectrometers are amongst the cheapest mass spectrometers, and are widely used.

Linear RF ion traps (also known as 2D ion traps because the electrical fields in the interior only change in two dimensions) consist of two or more pairs of pole rods supplied with RF voltage, and end electrodes whose inhomogeneous RF potentials can repel both positive and negative ions. If it is desired to store both positive and negative ions simultaneously, special steps must be taken with respect to their storage in the axial direction. For instance, RF voltages can be used to generate pseudopotentials at the ends in order to retain ions of both polarities. Two-dimensional ion traps with four pole rods form an internal quadrupole field, and can be used as mass analyzers in the same way as 3D ion traps. Here again there are different scanning procedures, such as those using the mass-selective ejection of ions through slots in the pole rods, or through diaphragms at the end of the rod systems. Commercial devices of this type at present cover a range of mass-to-charge ratios extending up to m/z=2,000 Daltons.

It is a particular feature of all RF ion trap mass spectrometers, that the absolute mass resolution $Ra=1/\Delta m$ is constant, and not the relative mass resolution $Rr=m/\Delta m$ as with other types of mass spectrometer. This means that the width of the ion signals in ion trap mass spectrometers is constant over the whole mass range (measured in terms of the mass-to-charge ratio, m/z), whereas for practically every other kind of mass spectrometer, the width of the ion signals grows in proportion to the mass-to-charge ratio m/z. For ion trap mass spectrometers, therefore, the resolution for an isotope pattern increases under deprotonation; for all other types of mass spectrometer, the resolution for the isotope pattern is approximately constant under deprotonation.

Internally, quadrupole ion traps contain a principally quadrupole RF electrical field that drives ions above the lower mass threshold toward the center, as a result of which the ions in this field are subject to what are called secular oscillations. The restoring forces in the ion trap can be described by what is referred to as a pseudopotential, given by a temporal averaging of the forces acting on an ion in forced oscillation in the real potential. The pseudopotential rises quadratically in two or three spatial directions. The ions, both positive and negative, can oscillate in this pseudopotential "well".

The presence of a collision gas in the ion trap has the effect of decelerating the original oscillations (the secular oscillations) of the ions in the pseudopotential well; the ions then collect as a small cloud in the center of the ion trap. In usual ion traps, typically filled with some tens of thousands of ions, the diameter of the cloud is around one millimeter. In 3D ion traps the cloud is elliptical in shape, whereas in 2D ion traps it takes the form of an elongated thread. The diameter is determined by an equilibrium between the restoring force of the pseudopotential and the repulsive Coulomb force between the ions. Residual thermal energies enlarge the ion cloud by a very small amount.

RF ion trap mass spectrometers equipped with special ion sources for the production of negatively charged reactant ions are available commercially. They can be used to create both radical anions for fragmentation by electron transfer and non-radical anions for reducing the number of protons of analyte ions by the transfer of protons from the analyte ions to the negative reactant ions. Negative ions for deprotonation can, however, also be made in the electrospray ion sources with which the vast majority of ion trap mass spectrometers are equipped.

It is particularly favorable for de novo sequencing, and also for spectral evaluation purposes, to record ergodic fragment ion spectra along with electron-induced fragment ion spectra. De novo sequencing is always desirable when a search engine fails to find any reasonable results in a protein sequence database because, for instance, a protein of this type is not yet present in the database. A comparison of the ergodic and electron-induced fragment ion spectra allows the ion signals to be immediately assigned to the c/b series or the z/y series. This is because there are fixed mass differences between the c-ions and the b-ions, as there are between the z-ions and the y-ions, from which the association can easily be seen. As a result, partial sequences for both series of fragment ions can easily be read. Modifications are also easy to identify, as side chains like phosphorylations or glycosylations are preserved with electron-induced fragmentation, whereas they are lost in ergodic fragmentation. The differences make the modifications visible.

The easy generation of ETD fragment ion spectra therefore does not mean that the generation of ergodic fragment ion spectra is superfluous, as a great deal of valuable information is only obtained by putting the two types of fragment ion spectra side-by-side.

SUMMARY

The invention provides a method for creating fragment ion spectra, suitable for evaluation, from highly charged protein ions in mass spectrometers with ion traps; the method can be characterized by the fact that partial deprotonation of the protein ions, the fragment ions, or both, is carried out by reactions with reactant anions in such a way that a mixture of fragment ions carrying between one and essentially only n charges, where $3 \leqq n \leqq 8$, is produced. The most favorable maximum number n of charges on the fragment ions depends on the mass resolution of the mass analyzer, which must be capable of delivering mass spectra in which the isotope patterns are resolved. The smaller the maximum number n of charges, the more evenly distributed are the intensities within the fragment ion spectrum; the greater the maximum number n of charges, the better is the sequence coverage. In contrast to the prior art, therefore, deprotonation is not continued until the fragment ions have one or at most two charges, as this does not yield high sequence coverage.

It is particularly favorable to perform partial deprotonation of the protein ions before they are fragmented; the deprotonation is halted at a selected charge level by resonant excitation of the secular oscillations. The charge level down to which deprotonation is carried out is selected so as to be favorable both for the subsequent fragmentation and for the resulting mixture of fragment ions. Ergodic fragmentation of the protein ions of a charge level with k protons yields a mixture of fragment ions carrying between 1 and k charges, whereas electron-induced fragmentation yields a mixture with charge levels extending from 1 to (k−1). The special feature of this process is that the fragment ions of all the charge levels that result have about the same intensity, in complete contrast to deprotonation of the fragment ions after fragmentation.

The charge level at which fragmentation takes place can also be reached in two or more steps. This requires heavy reactant anions. The mass-to-charge ratio m/z of the protein ions at the selected charge level k can also well lie outside the scanning range of the RF ion trap.

Partial deprotonation of the protein ions prior to fragmentation has many advantages. First, the protein ions of the various charge levels created in the ionization process are collected at a single charge level, and the protein ions are utilized more efficiently. The collection makes it unnecessary to isolate the selected parent ions, because the collection destroys interfering ions of other substances. The mixture of fragment ions created from this contains all the various charge levels at uniform intensity. For collision-induced dissociation, it is this that makes fragmentation possible, as only parent ions with a relatively high mass-to-charge ratio can be fragmented. In the case of electron-induced fragmentation, the creation of internal fragments is reduced.

If the maximum charge level n is chosen correctly for the mixture of fragment ions, a spectrum of these ions with good isotopic resolution can even be obtained in ion traps that are used as mass analyzers. On the basis of the isotope-resolved signals of these reduced-charge fragment ions, it is possible, for instance, to calculate a "virtual mass spectrum" that consists only of the monoisotopic signals of singly charged ions. This entails an additional "computed deprotonation", combined with a non-trivial computed determination of the mass of the monoisotopic signal of the isotope pattern of a fragment ion; for high-molecular ions, this signal cannot itself be measured, and can only be obtained by calculations from the isotope pattern.

In the case of electron-induced fragmentation, stable radical cations sometimes form, which do not immediately decompose. Since the radical cations are formed here from a single type of ion, they can be subjected to further collision-induced dissociation by means of weak resonant excitation of their secular oscillations; they decompose and yield the fragment ions that are typical of electron-induced fragmentation. The frequency required for this alternating excitation voltage can be calculated from the known mass of these radical cations and from their known charge. The effect of this excitation voltage is to raise the yield of the desired ion types.

In spite of this emphasis on the advantages of deprotonation prior to fragmentation, the inverse sequence should not be ruled out. Deprotonation after fragmentation can also yield the desired mixture of fragment ions with between one and n charges.

The special feature of this invention is that the combination of deprotonation and fragmentation creates a mixture of ions consisting of fragment ions with between one and n charges.

This sharply reduces the absolute number of fragment ion signals and distributes them more evenly over a significantly wider mass range, so that the number of isotope patterns that overlap is markedly reduced. For the case of $n \leqq 4$ this means that the fragment ions can be measured, with resolution of the isotopes, in ion traps that are also used as mass analyzers. For n=4, sequence coverages of 12,000 Daltons, extending over both ends of the sequence, can be achieved in an ion trap with a scan range of m=3,000 Daltons for singly charged ions. For the case where $5 \leqq n \leqq 8$ it is necessary to use a mass analyzer with an appropriately high resolution for the measurements. From the isotope-resolved mass spectra of the reduced-charge fragment ions thus measured, it is possible to apply known methods to calculate a virtual mass spectrum consisting of only the monoisotopic signals of singly charged fragment ions.

Both the radical anions for electron transfer dissociation and the negative reactant anions for deprotonation can be created in an ion source for the chemical generation of negative ions (NCI ion source) and fed into the ion trap. One or both types of reactant anions can, however, also be created in a conventional electrospray ion source or other ion source operating at atmospheric pressure (APCI=atmospheric pressure chemical ionization; APPI=atmospheric pressure photo ionization).

DETAILED DESCRIPTION

Figure 1:
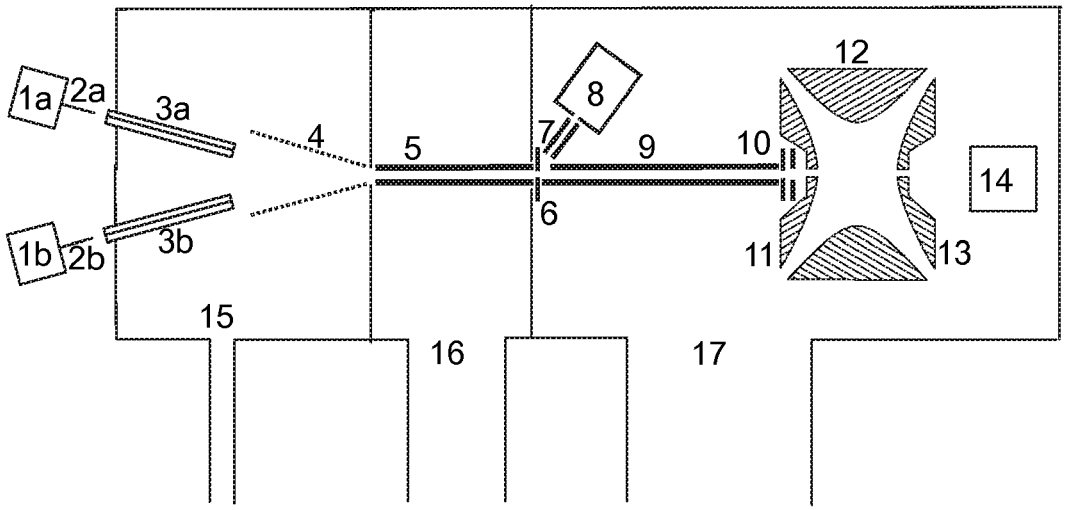
FIG. 1 illustrates the scheme of an ion trap mass spectrometer for performing a method according to this invention, here having two electrospray ion sources to be operated in parallel (1*a*, 2*a* and 1*b*, 2*b*), an ion funnel (4), an electron attachment ion source (8) for generating negative ions and a 3D ion trap with end cap electrodes (11, 13) and a ring electrode (12). The ion guide (9), here implemented as an octopole rod system, can guide both positive and negative ions to the ion trap. One of the two electrospray ion sources can, for instance, be used to create heavy negative reactant ions for deprotonation.

While the invention has been shown and described with reference to a number of embodiments thereof, it will be recognized by those skilled in the art that various changes in form and detail may be made herein without departing from the spirit and scope of the invention as defined by the appended claims.

The invention provides a method for mass spectrometers with ion traps, by means of which the mass spectra of fragment ions are obtained going far beyond the original mass range of the mass analyzers for singly charged ions, and providing a basis for top-down analysis methods for medium-mass proteins. The invention is based on the generation of highly charged protein ions, such as may be produced by electrospraying medium-mass protein molecules, although other ionization methods may also be used. Any type of Penning and Paul ion trap may be used for the method, but the procedures of the method vary with different types of ion trap.

In RF ion traps, particularly favorable embodiments of the method according to the invention start from partial deprotonation of the highly charged protein ions prior to fragmentation, where the deprotonation is halted at a specific charge level that is chosen in advance. The various forms of the embodiment starting from this basis then differ in the type of fragmentation; both ergodic methods and non-ergodic methods, in particular electron-induced fragmentation, can be applied.

The deprotonation occurs through reactions of the highly charged protein ions with suitable reactant anions. The reactant anions are usually non-radical anions; a large number of different classes of substance may be considered for the formation of these reactant anions. A deprotonation reaction consists in a proton transfer from a highly charged protein ion to a reactant anion, whereby this is neutralized without forming a radical in the process. The deprotonation reactions have reaction cross-sections that are proportional to the square of the level of charge on the highly charged protein ions; the reactions occur with extraordinary speed for highly charged protein ions.

Stopping the deprotonation at a preselected level of charge is achieved in an RF ion trap by using a dipolar alternating voltage to create weak resonant excitement of the protein ions which, as a result of continued deprotonation, have reached this particular level of charge. The excitation must not be so strong that the protein ions are ejected from the ion trap. An equilibrium between the excitation by the dipolar alternating voltage and the damping by the collision gas must be achieved. This kind of weak excitation is known for ion traps (for collision-induced dissociation, for instance), and can be applied by the software control of any commercially available ion trap. The movement of the protein ions resulting from their secular oscillation prevents any further deprotonation reactions, as these only take place at low relative velocities.

Since the weak resonant excitation of the protein ions does not bring them immediately into oscillation, but they pass through an initial oscillation phase of low velocity, the deprotonation reactions must not take place at too high a speed. Otherwise the protein ions will experience further deprotonation before they reach the phase of full-strength oscillation stopping further deprotonation. The speed of the deprotonation reactions can be controlled through the supply of reactant anions.

The duration of the start-up phase of the oscillation becomes longer as the secular oscillation becomes slower. At a given RF voltage, the frequency of the secular oscillation is inversely proportional to the mass-to-charge ratio m/z; for a small number of charges, z, the oscillation frequency is therefore unfavorably low. On the other hand, the oscillation frequency rises with the RF voltage in the ion trap; it is therefore favorable to select as high a voltage as possible.

This can be explained with the aid of an example: electrospray ionization adds approximately 10 to 30 protons to protein molecules of 15 kilodaltons, which means that the mass-to-charge ratio of the highly charged protein ions extends over the range from 500 to 1,500 Daltons. In order to deprotonate all these highly charged protein ions, the RF voltage should have a level such that the lower mass threshold is located at about 500 Daltons. No highly charged protein ions will then be lost. If we now choose to halt deprotonation at a charge level k=5, the protein ions at this charge level will have a mass-to-charge ratio m/z=3,000 Daltons. In spite of the moderately high level of the RF voltage, these protein ions oscillate very slowly, and this is unfavorable.

This situation can be improved through two-stage deprotonation. For the first phase of deprotonation it is possible, for instance, to choose k=14, so collecting the ions at a mass-to-charge ratio m/z=1,071 Daltons. For these ions, the frequency of the secular oscillation is about three times greater, and the process of deprotonation can therefore proceed about three times faster. The total duration of this first phase of the deprotonation is very short. After this, the RF voltage can be doubled, so that the lower mass threshold is now located at 1,000 Daltons. In order to stop at k=5 it is now possible to double the reaction speed in comparison with single-stage deprotonation. As the second phase of the two-phase deprotonation is also significantly shorter than the total duration of single-stage deprotonation, time is saved through two-stage deprotonation.

This type of deprotonation does, however, require the reactant anions to have a high molecular mass, as they must be above the mass threshold of the ion trap. It is possible to generate reactant anions with molecular masses this high, namely 1,000 Daltons or more, in electron attachment ion sources according to FIG. 2, but this requires vaporizable substances with these molecular masses, for instance highly brominated or iodinated polyaromatics or polyethers. A wide range of different substances is, however, available if an electrospray ion source is used to create these reactant anions. The electrospray ion source does not have to be identical with the ion source that generates the protein ions, but can instead be arranged in parallel with it, as schematically indicated in FIG. 1. The electrospray ion source for the reactant anions can also contain special auxiliary devices, such as a needle for corona discharge, to support the negative electrospray by chemical ionization.

The deprotonation, halted at a selected charge level k, now delivers protein ions that can be favorably fragmented either by ergodic or by electron-induced techniques.

Fragmentation by infrared multiphoton dissociation (IRMPD) now yields fragment ions with charges between 1 and n=k; the advantage here is that all the charge levels are represented equally strongly in the mixture of fragment ions, in contrast to deprotonation of the fragment ions after fragmentation of the highly charged protein ions.

Deprotonation prior to fragmentation is essential for collision-induced dissociation because the highly charged protein ions in the mass-to-charge ratio m/z range from 500 to 1,000 Daltons cannot be fragmented at all. It is not possible with these highly charged protein ions to set the RF voltage so high that the collisions contain such a high level of energy that energy can be pumped into the ions by these collisions. The energy thresholds needed for the excitation of specific oscillation states must be exceeded by the collisions, otherwise the collisions will be perfectly elastic, resulting in simple reflection of the collision gas molecules. This is particularly true when helium is used as the collision gas. Helium is very often used in commercially manufactured RF ion traps, as it causes very little disturbance to the scanning procedure for spectral recording.

By collecting the protein ions with a high mass-to-charge ratio m/z in the deprotonation process described above at a sufficiently low charge level k, the preconditions for collision-induced dissociation are now created. Hard collision conditions can now be provided by increasing the RF voltage. The RF voltage is set to a level high enough that the lower mass threshold is positioned at least at a half, better still between two thirds and three quarters, of the mass-to-charge ratio m/z of the protein ions. It is then sufficient to provide a relatively short resonant excitation of only a few milliseconds, possibly even less, to pump sufficient energy into the protein ions for fragmentation through collisions. The fragmentation does not occur here instantaneously, but is delayed by the half-life of the ergodic fragmentation. The half-life becomes longer as the margin by which the internal excess energy exceeds the binding energy decreases. On the other hand, the internal energy is also reduced by energy-releasing soft collisions with the collision gas, so that a compromise must be found experimentally.

If resonant excitation is applied when the RF voltage is at a high level, then not only is secular oscillation generated, but forced oscillation in synchronism with the RF voltage is imposed onto the secular oscillation. The amplitude of the forced oscillation becomes greater as the margin by which the mass-to-charge ratio of the resonantly excited ions exceeds the lower mass threshold of the ion trap decreases. Since the frequency of the forced oscillation is greater than that of the secular oscillation by a factor of two (directly above the mass threshold) to four (at twice the mass threshold), it makes a significant contribution to the energy of the collisions. The forced oscillation can also be used alone, by applying a DC voltage, via the two end caps, which moves the ions away from the center, so that they experience the forced oscillation of the RF field outside of the center. The DC voltage then acts on all the ions in the ion trap, as there is no longer resonant excitation of one single ion type. The DC voltage acts on heavy ions more than on light ions, as the restoring forces of the pseudopotential are smaller for heavy ions.

The energy of the collisions can also be increased by using a heavier collision gas. Nitrogen or argon, for instance, may be considered. Commercial ion trap mass spectrometers avoid the addition or exclusive use of heavy collision gases, as they cannot be pumped away quickly enough to achieve scanning processes with high resolution.

The RF voltage prevents the storage of small fragment ions. These are, however, of crucial importance for evaluation of the fragment ion spectrum. The RF voltage must therefore be lowered again immediately after the collision phase. This must be controlled in such a way that all the highly oscillating protein ions are damped more quickly than the oscillations propagate in the RF field as it becomes weaker and, as a consequence, the pseudopotential well becomes shallower. Otherwise at least some of the ions will be lost over the edge of the pseudopotential well as a result of their oscillation. The collision phase must only be short, and usually just a few milliseconds is enough.

If a low value of the lower stability limit is reached, m/z=150 Daltons for instance, the majority of fragment ions from all the late decays now taking place will also be held in the ion trap. If the fragment ions are still too highly charged, their charge level can be lowered by further deprotonation.

For electron-induced fragmentation, collecting the protein ions at a preselected charge level k is again ideal. Fragment ions with charge levels from 1 to n=(k−1) are then formed. Here too, the advantage is that, in addition to equalization of the fragment ion spectra, a mixture of fragment ions is created in which the fragment ions at the charge levels from 1 to (k−1) have approximately the same intensity. This is much less the case if the deprotonation is carried out after the electron-induced fragmentation.

In RF ion traps, electron-induced fragmentation by electron transfer dissociation (ETD) is relatively easy to carry out, particularly if a source for radical anions is available. For this purpose, suitable radical anions are introduced according to known methods. The incomplete saturation of the chemical valences on these anions causes them to donate an electron to the multiply positively charged protein ions. The reactions can take place at very low RF voltages, for which reason small fragment ions are also captured.

Figure 2:
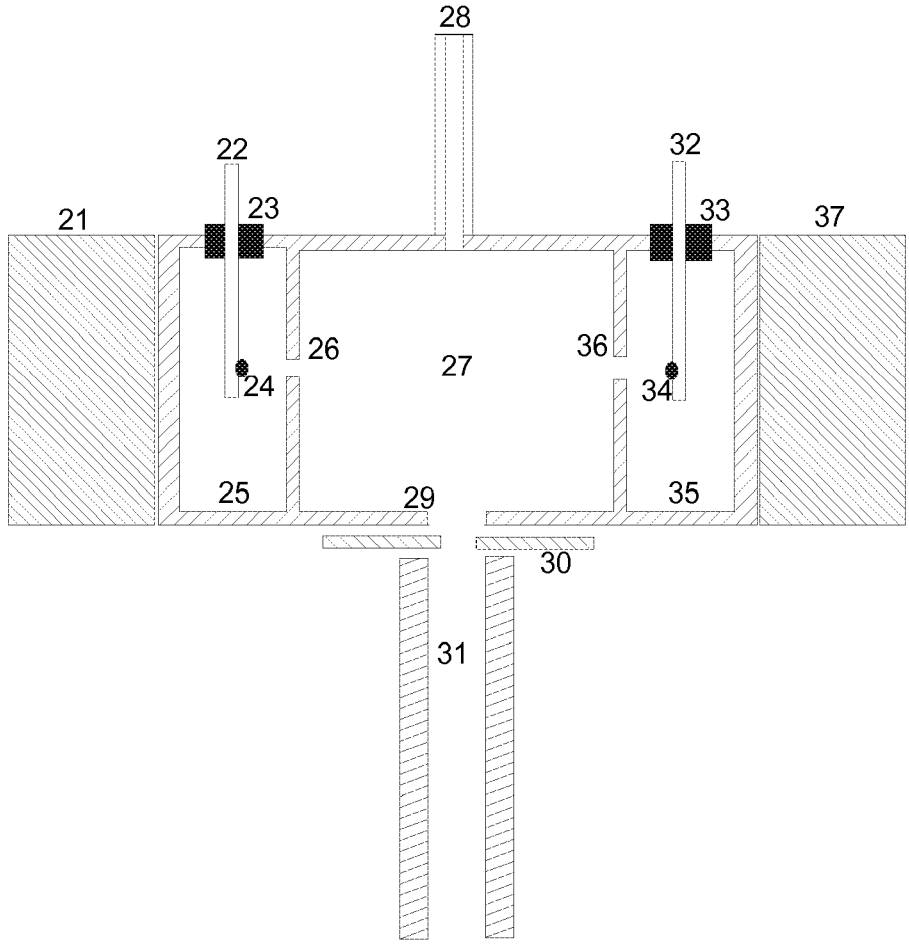
FIG. 2 shows an electron attachment ion source in which a beam of electrons leaving the thermionic cathode (24), guided by two magnets (21) and (37) ionizes the gaseous fluoranthene entering through the feeder (28) in the presence of methane in the chamber (27). The resulting anions are extracted from the opening (29) with the aid of the extraction diaphragm (30) and introduced into the hexapole ion guide (31). When the extraction voltage is low, radical anions are almost exclusively extracted, whereas a higher extraction voltage predominantly extracts only non-radical anions.
Figure 5:
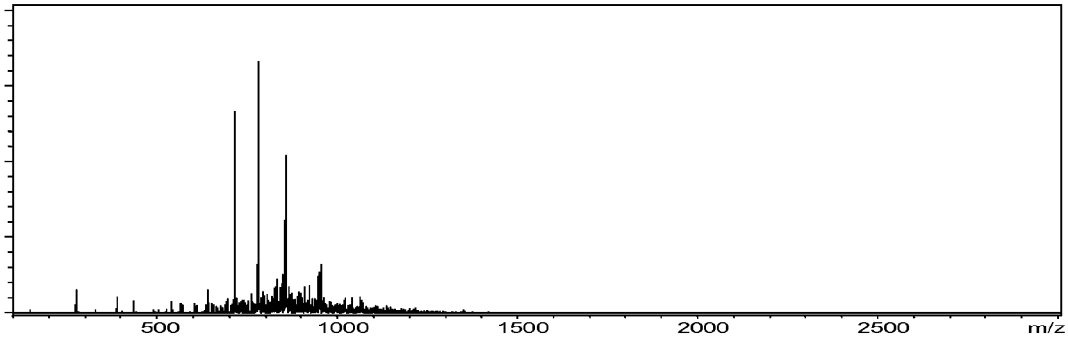
FIG. 5 shows the fragment ion spectrum generated from the analyte ubiquitin ions with 12 charges by electron transfer dissociation. The majority of fragment ions are in the range between 600 Daltons and 1,200 Daltons. Some radical ions have been formed, too; they appear with high intensities

A typical electron attachment ion source, as is shown on FIG. 2, can be used to create the radical anions. Suitable radical anions $M^{\bullet -}$ for electron transfer dissociation are prepared by electron attachment to suitable reactant substances; as is known, reactant substances of various types can be used including, for instance, fluoranthene, fluorenone, anthracene or other polyaromatic compounds. It is, in principle, also possible to use a mixture of reactant substances in order to generate a mixture of radical anions. The radical anion of fluoranthene was used for the fragmentation of the ubiquitin whose fragment ion spectrum is illustrated in FIG. 5.

If the protein ions are very well thermalized, the electron transfer dissociation sometimes creates metastable radical cations, which do not immediately decompose. Since the radical cations are formed here from a single type of ion, namely the protein ions whose charge level is k, weak resonant excitation of the secular oscillations of the radical cations can lead to collisions that assist fragmentation, causing them to decompose and yield the fragment ions that are typical of electron-induced fragmentation. The frequency required for this alternating excitation voltage can be calculated from the known mass of these radical cations and from their known charge. The effect of this excitation voltage is to raise the yield of the desired ion types. These radical cations may sometimes lie outside the mass range of the ion trap used for spectral recording, for instance at m/z=4,000 Daltons in an ion trap whose mass range for spectral recording only extends to m/z=3,000 Daltons; nevertheless, the frequency of their secular oscillation can be calculated, and they can be resonantly excited.

In specially constructed ion traps, for instance the kind of ion trap that is operated with a rectangular RF voltage, it is, however, also possible to use electron capture dissociation (ECD).

If a source of highly excited neutral particles is available in an ion trap mass spectrometer, then dissociation can easily be achieved with metastable atoms (MAID). Here again, it is favorable that uniform mixtures of fragment ions of all charge levels are obtained.

In Penning ion traps, which are used in ICR mass spectrometers, deprotonation can also be carried out by reactions with non-radical anions. Here, very light anions, for instance anions of benzoic acid, are particularly used. Here again it is possible to halt the deprotonation at a specific level of charge by exciting the cyclotron or magnetron oscillation of the protein ions at that charge level. The excitation must not, however, last for a long time; but it is known that, by using frequent phase jumps, the ions can be induced to move in a way that does not end in an ever-growing spiral. In addition, it is also possible here to apply a resonant quadrupole alternating field to achieve a dipolar oscillation of finite amplitude.

In spite of the emphasis given to the advantages of deprotonation prior to fragmentation, deprotonation after fragmentation remains useful for the purpose of the invention, which aims to generate a mixture of fragment ions with charge levels from 1 to n, with a previously specified maximum charge level n in the range $3 \leqq n \leqq 8$, in order to provide (a) resolution of the isotopes in the scan, (b) a reduction in the number of fragment ion types, and (c) a more even distribution of the ion masses and intensities in the fragment ion spectrum. Deprotonation can be done in this way in any kind of ion trap after any kind of fragmentation of which the ion trap is capable. Deprotonation following fragmentation must be halted early enough, after a preselected reaction time.

An example is given here by the deprotonation of the fragment ions of ubiquitin after they have been created in an RF ion trap, where the ion trap is also used as the mass analyzer. Ubiquitin serves here as an example of a medium-mass protein; it has a molecular mass of 8,560 Daltons for the monoisotopic molecule.

A favorable embodiment of the ion trap mass spectrometer is shown schematically in FIG. 1. In this case, one of the two electrospray ion sources (1*a, b*) with a spray capillary (2*a, b*) outside the mass spectrometer is used to analyze the high-molecular proteins. The high-molecular protein is in an aqueous solution, to which organic solvents such as methanol or acetonitrile are added to assist the spraying. The highly charged analyte anions created by electrospraying are guided in the usual way through an inlet capillary (3*a, b*) and an RF ion funnel (4) into the ion guide (5); most of the ambient gas that is also fed in is evacuated. With the aid of the ion guides (5) and (9), the highly charged analyte ions are fed through pressure stages (15), (16), (17) into the 3D ion trap with end cap electrodes (11 and 13) and a ring electrode (12), and are trapped there in the usual way. The ion guides (5) and (9) consist of parallel pairs of rods to which alternating phases of an RF voltage are applied. They are usually implemented as hexapole or as octopole rod systems.

Figure 3:
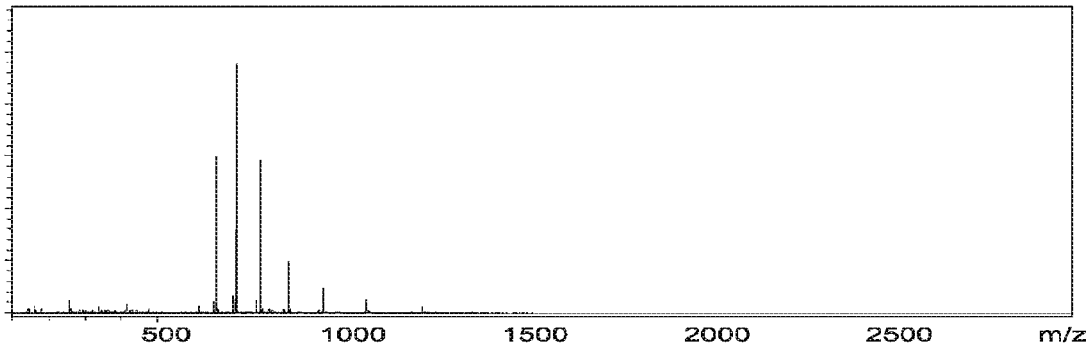
FIG. 3 shows a mass spectrum of the analyte ions of ubiquitin (molecular mass 8560 Daltons) generated by electrospraying. The ions have between 7 and 14 charges, analyte ions with 12 charges being the most common.
Figure 4:
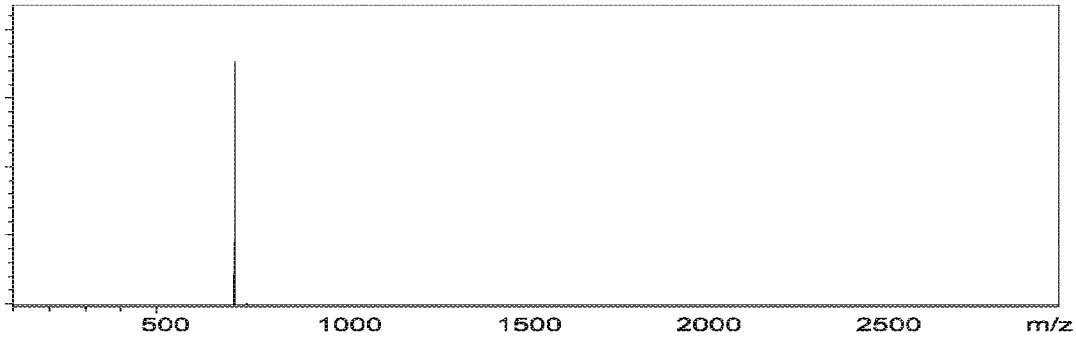
FIG. 4 illustrates a mass spectrum of the isolated ubiquitin ions having 12 charges, selected as parent ions.

A first mass spectrum, obtained by resonant excitation of the ions with mass-selective ejection and measurement in the ion detector (14) provides an overview of the various charge levels of the analyte ions. Such a mass spectrum of ubiquitin, with a broad distribution of the charge levels from 7 to 14, is shown in FIG. 3. After filling the ion trap again, it is now possible to isolate the ion type of a chosen charge level using usual techniques; these ions then represent the parent ions for fragmentation. For this purpose, an excess of ions is first introduced into the trap, so that enough ions will remain at a later stage for a good scan, and then all ions other than the selected parent ions are ejected out of the ion trap. FIG. 4 reproduces the mass spectrum of ubiquitin after isolating those ions with charge level 12. Zooming closely into the mass spectrum would show that the isotopes are not resolved.

These highly charged analyte ions are then decelerated and brought to the center of the trap by a brief waiting time of a few milliseconds by the action of the impact gas, which is always present. There they form a small cloud with a diameter of about 1 millimeter.

Then the highly charged parent ions, in this case the ubiquitin ions with 12 charges, are fragmented. Electron transfer dissociation is carried out in this case, but other types of fragmentation can also be utilized. Special negatively charged ions, in particular radical anions of suitable substances such as anthracene or fluoranthene, are added for the electron transfer dissociation.

These radical anions are generated here in a separate ion source (8) for negative chemical ionization, and channeled through a small ion guide (7) to an ion guide merger station, where they are inserted into the ion guide (9) and guided to the ion trap (11, 12, 13). In the embodiment illustrated, the ion guide merger station consists simply of an apertured diaphragm (6) and shortening two of the rods which make up the ion guide (9). For this very simple type of ion guide merger station it is particularly favorable for the ion guide to be implemented as an octopole system. This ion guide merger station can let the ions from the electrospray ion source (1*a*, 2*a*) pass unhindered if suitable voltages are applied to the apertured diaphragm and suitable DC voltages on the axes of the octopole rod system (5) and (9); with other voltages the negative ions from the ion source (8) are reflected into the ion guide (9). They reach the ion trap through this ion guide (9), and are injected there in the usual way by an injection lens (10).

A favorable electron attachment ion source is illustrated in FIG. 2. A beam of electrons leaves the thermionic cathode (24) located on mounting post (23) with an energy of about 70 electron-volts, and is guided by two magnets (21) and (37) through the chamber (27). In the chamber (27), the gaseous fluoranthene entering through the feeder (28) is ionized in the presence of methane, which also enters through the feeder (28). The resulting anions are extracted from the opening (29) of the chamber (27) with the aid of the extraction diaphragm (30) and introduced into a hexapole ion guide (31). The thermionic cathode (34) on mounting posts (32), held by insulators (33) in chamber (35), is a reserve emitter, capable to emit a second electron beam through opening (36) into the ionization chamber (27). It is also possible to generate the non-radical anions for the deprotonation in this electron attachment ion source. When the extraction voltage is low, radical anions are almost exclusively extracted, whereas a higher extraction voltage predominantly extracts only non-radical anions. The electron attachment ion source and hexapole ion guide (31) correspond to the ion source (8) and the ion guide (7) in FIG. 1.

The radical anions react immediately (within a few milliseconds) with the positive analyte ions already stored in the RF ion trap, and these fragment in the known way, forming fragment ions of the c and z series. A very large number of fragment ions are formed from high-molecular protein ions. As a rule, the heavy fragment ions are again highly charged, while the light fragment ions have a significantly lower charge. FIG. 5 illustrates the fragment ions obtained from ubiquitin in this way; they are concentrated around a relatively narrow m/z range from 600 to 1,200 Daltons.

Usually a fixed quantity of radical anions is introduced for the electron transfer dissociation of the analyte ions, and the process is then stopped after a preselected time by rapidly removing the remaining radical anions so that the fragment ions that have just been created are not subject to further fragmentation. Further fragmentation of this type yields what are known as "internal fragments", and this makes the evaluation of the mass spectrum more difficult. Removal of the remaining radical anions can favorably be carried out by resonant excitation of the secular oscillations of these ions; there are, however, other methods. This type of fragmentation by electron transfer only takes about 5 to 30 milliseconds, including ejection of the residual radical anions.

After a short stabilization period of a few milliseconds, the negative ions can now be supplied for deprotonation. The deprotonation is done very easily by proton transfer from the ions with multiple positive charges to special kinds of negatively charged ions, most particularly to non-radical anions. The reaction cross-sections for these proton transfer reactions are proportional to the square of the number of proton charges on an ion; the deprotonation therefore happens very quickly for highly charged ions, while the reaction speed is sharply reduced for ions with lower charges. Ions having ten charges are therefore deprotonated about one hundred times faster than singly charged ions, and still six times faster than ions with four charges.

The non-radical anions for deprotonation can be generated in the same ion source (8) in which the radical anions have already been created. They can, however, also be generated in one of the two electrospray ion sources (1*a*, 2*a*) or (1*b*, 2*b*), usually with the aid of a second spray capillary (2*a*) or (2*b*). It is equally possible to generate the non-radical anions by corona discharge at the inlet area of one of the two inlet capillaries (3*a*) or (3*b*).

Figure 6:
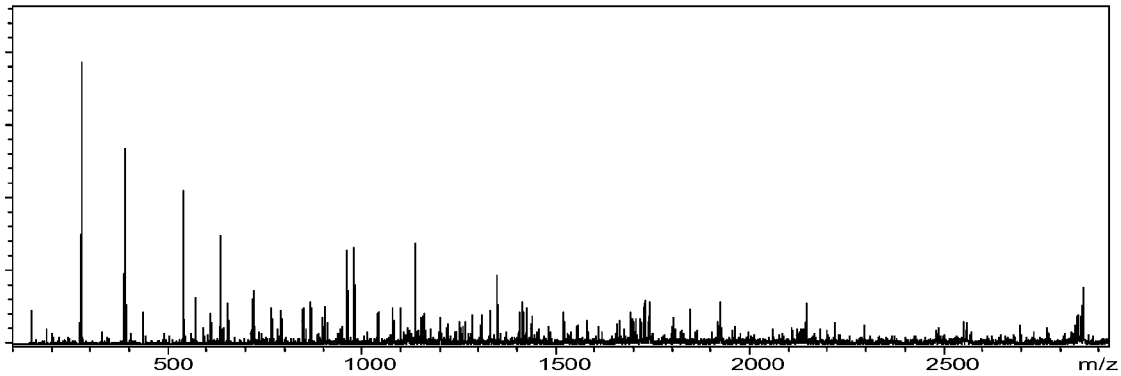
FIG. 6 shows the mass spectrum of the ubiquitin fragment ions with reduced charge, obtained by deprotonation of the ions shown in FIG. 5. The mass spectrum has become substantially more widespread and more evenly distributed in intensities.

If the supply of non-radical anions for deprotonation is halted when a preselected, low level of charge is reached, for example a mixture of fragment ions each carrying between one and four charges, then by using the ion trap (11, 12, 13) as a mass analyzer, an isotope-resolved mass spectrum for the fragment ions can be measured. The duration of the deprotonation process depends on the rate at which the non-radical anions are generated, and is generally between 20 and 200 milliseconds. FIG. 6 clearly shows that the fragment ion spectrum of the ubiquitin, now only containing ions with up to four charges, now shows more evenly distributed intensities and extends relatively evenly across the mass range that has been set here for the ion trap mass analyzer, namely m/z=150 to 3,000 Daltons.

On the basis of this more evenly distributed isotope-resolved mass spectrum of the ubiquitin fragment ions shown in FIG. 6, it is possible to calculate a virtual mass spectrum of the singly charged, monoisotopic ubiquitin fragment ions.

Such a virtual mass spectrum of fragment ions now comprises a mass range that is several times greater than the original mass range of the mass analyzer for singly charged ions. This yields a higher sequence coverage than would be provided by deprotonating down to the level of a single charge. The virtual mass spectrum of the fragment ions can be used for identification or for the identification of modifications in search engines, but is also available for a wide range of investigations or representations, for instance for displaying mass spectra annotated with the amino acids. The word "mass spectrum" should not simply be understood here as a graphical diagram; the mass spectrum can equally well comprise a list of the masses of the monoisotopic signals and their intensities.

When the ion traps are also used as mass analyzers, the invention makes use of the fact that it is possible to resolve the isotope patterns of ions with up to four charges. This is not possible for more highly charged ions. For spectra with resolved isotope patterns, the spacing of the signals in the isotope patterns can very easily be used to determine the charge level of the ions in this isotope pattern. For doubly charged ions this spacing is always ½ Dalton, for triply charged ions the spacing is ⅓ Dalton, and for ions with four charges, ¼ Dalton. This allows the mass of the singly charged ions $(A+H)^+$ to be calculated directly. It is two, three or four times the mass-to-charge ratio m/z of the $(A+2H)^{2+}$, $(A+3H)^{3+}$ or $(A+4H)^{4+}$ ions respectively, minus the mass for the number of protons $H^+$, which are not present on the singly charged ions.

Since, however, the virtual mass spectrum should only contain the masses of the monoisotopic signals, the method assumes that mathematical methods of mass determination exist for the monoisotopic signal of an isotope group. For larger proteins, in the range from 5 to 100 kilodaltons, this task is no longer trivial, but is described in patent DE 198 03 309 C1 (C. Köster; GB 2 333 893 B; U.S. Pat. No. 6,188,064 B1). The monoisotopic signal belongs to those ions in an isotope pattern which consists only of the primary isotopes $^1H$, $^{12}C$, $^{14}N$, $^{16}O$, $^{31}P$ and $^{32}S$. For very large proteins, the intensity of this monoisotopic signal is vanishingly low in intensity, and can only be deduced from the other signals in the isotope group. A protein with a mass of 5,000 Daltons still has a monoisotopic signal that makes up around five percent of the total of the signals from all the isotopes; a protein with a mass of 8,000 Daltons has a monoisotopic signal amounting to only 1 percent. For proteins that are even heavier, the monoisotopic signal is hardly detectable at all: even for a protein with a mass of 10,000 Daltons, the monoisotopic signal has shrunk to only 0.2 percent. This mathematical method also makes it possible to detect and separate isotope patterns that are superimposed in relatively complex ways.

In order to determine the mass of the monoisotopic ion, the mass of the relevant fragment ion is first estimated from the isotope pattern. Based on the knowledge we have about proteins, the average composition in terms of the elements H, C, O, N, P and S can be found. From this composition, known methods can be used to calculate an isotope pattern for a fragment ion of this mass. This calculated isotope pattern is now fitted to the measured isotope pattern; this gives the mass-to-charge ratio m/z of the monoisotopic fragment ion, which still has multiple charges, however. This method is repeated for all isotope patterns, the results being entered in a table containing the mass-to-charge ratios, the charge levels and the intensities of all the measured fragment ions. For the intensities, it is appropriate to enter the totals of all the intensities of the fragment ions of an isotope pattern.

This table is then converted into the virtual mass spectrum of the fragment ions by calculating the appropriate figures for singly charged fragment ions. If m* is the mass-to-charge ratio m/z of the fragment ion charged n times with $H^+$ protons $(F+n\times H)^{n+}$, then the mass m of the singly charged fragment ions $(F+H)^+$ can be calculated as follows:

$$m[(F+H)^+]=n\times m^*[(F+n\times H)^{n+}]-(n-1)\times m[H].$$

This virtual mass spectrum of the fragment ions, represented as a table, is of a form that is suitable for further processing by computation programs of all types, such as the search engines mentioned above, or by programs for identifying modifications of the amino acids such as phosphorylations or glycosylations.

This virtual mass spectrum has the advantage of covering a much greater mass range. With it, an ion trap whose mass range extends up to m/z=3,000 Daltons, and which can resolve ions carrying four charges, can be used to cover a range extending up to m=12,000 Daltons in the virtual mass spectrum. According to the prior art, in which deprotonation is continued until singly charged fragment ions are reached, only the original mass range is available for sequencing the amino acids. In contrast, the invention extends the mass range significantly further. The sequences of both ends of the amino acid chain are covered, that is the sequences of both the C-terminal and the N-terminal ends.

Figure 7:
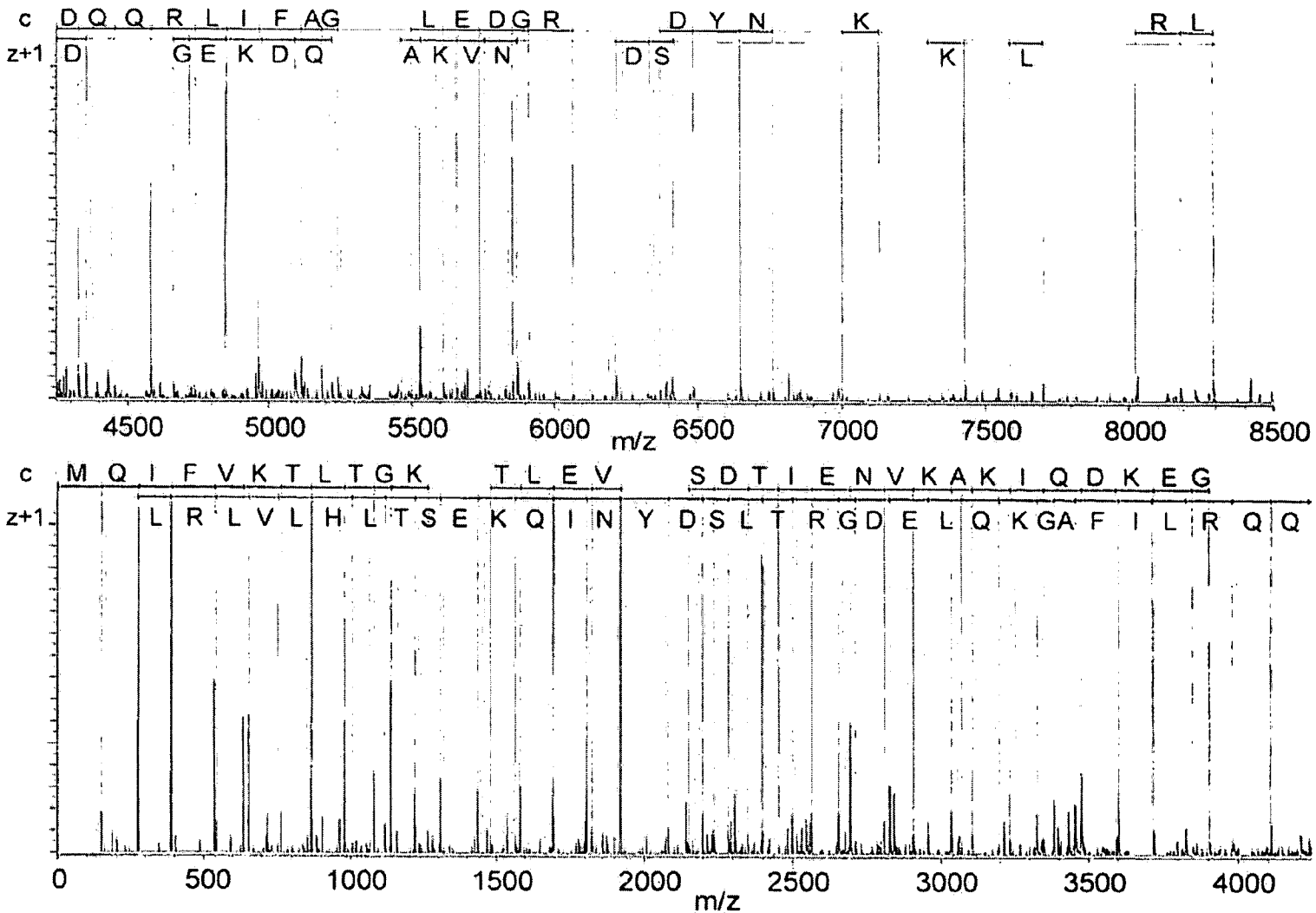
FIG. 7 illustrates the virtual mass spectrum of ubiquitin, calculated from the reduced-charge mass spectrum of FIG. 6. The annotations were made automatically by a computer program. The gaps in the annotations in the upper line, c, of the first half of the spectrum are due to the presence of proline, whose amide bond cannot be cleaved by electron transfer dissociation. A computer program of this type can, however, be taught to close such proline gaps through unambiguous assignment (not implemented here). The method of the invention would then achieve 96 percent sequence coverage.

FIG. 7 reproduces the virtual mass spectrum of the fragment ions of ubiquitin, annotated with the abbreviations of the amino acids. The program used here for the annotation was not set up to detect combinations of any amino acids with proline. The bond between proline and the amino acid that is bonded at the amide end cannot be cleaved by electron transfer dissociation, which is the reason for these gaps in the c series of the first half of the mass spectrum. If these gaps were annotated, the spectrum would show sequence coverage over 73 of the 76 amino acids. The GGR amino acids from the C-terminal end of the sequence are missing at the beginning of the (z+1)-row, as the ion trap was set to a lower mass limit of 150 Daltons during the fragmentation, and because the two glycines (G), with only 57 Daltons each, amount to less than 150 Daltons. For comparison, the sequence of ubiquitin is MQIFVKTLTG KTITLEVEPS DTIENVKAKI QDKEGIP-PDQ QRLIFAGKQL EDGRTLSDYN IQKESTLHLV LRL-RGG.

When the ion traps are also used as mass analyzers, the invention thus utilizes the fact that it is possible to resolve the isotope patterns of ions with up to four charges. This is not possible for more highly charged ions. For spectra with resolved isotope patterns, the spacing of the signals in the isotope patterns can then, as described above, very easily be used to determine the charge level of the ions in this isotope pattern.

In the case of mass spectrometers that do not use the ion trap itself as the mass analyzer, but are equipped with other types of mass analyzer, deprotonation does not help to achieve a higher isotope resolution if their relative resolution $R_r$ is constant, and all isotope patterns, regardless of the particular charge level, are resolved in the same way. Resolution of the isotopes of heavy ions must be provided here by a high mass resolution in the mass analyzer, as is, for instance, the case with ion cyclotron resonance mass analyzers. The advantage of the invention here is rather that the method of the invention greatly reduces the absolute number of the very many fragment ions, each with its more or less complicated isotope pattern, and that the heavy clustering of all the fragment ions in the range between 500 to 1,200 Daltons is spread over a larger mass range because the fragment ions of reduced charge levels are now distributed over this wide mass range, so reducing the number of overlaps of the isotope patterns.

For mass spectrometers with these other types of mass analyzer, it can be expedient not to deprotonate down to fragment ions with low charge levels of between one and four charges, but to also permit ions with moderately higher levels of charge, for instance ions with up to six or eight charges.

For this method of fragmentation prior to deprotonation, the highly charged analyte ions can be fragmented together as a mixture of ions with a number of charge levels; it is also possible to first isolate the analyte ions at one suitable charge level. The isotope pattern must here be fully preserved, so that the level of charge of the fragment ions can be read from the pattern.

The invention thus provides a method for obtaining good fragment ion spectra from heavy proteins in mass spectrometers with ion traps, which first generates highly charged ions of the proteins and stores them in the ion trap, deprotonates and fragments these analyte ions, although this sequence can also be reversed, and produces a mixture of fragment ions with reduced levels of charge extending from one to n, which yields spectra with good isotopic resolution, contains a lower number of fragment ions and distributes the fragment ion spectrum over a wide range of mass-to-charge ratios. The "virtual mass spectrum" of only singly charged, monoisotopic ions can be calculated from these fragment ion spectra.

A variety of methods are known for calculating the times required for optimally filling an RF ion trap that will also be used as the mass analyzer with highly charged analyte ions; these methods will not be considered in any more detail here. The correct filling time achieves optimum filling to just short of the point where the scan, made by the mass-selective ejection of ions, is disturbed by the space charge. Prior to the scan, the ion trap can be strongly overfilled for all the other processes of isolation, fragmentation and deprotonation; the only important point is that there must be no overfilling during the scan itself.

For the purposes of filling with negative ions—both the radical anions required for fragmentation and the non-radical anions for deprotonation—it is generally only necessary to determine an optimum filling quantity or filling time once, as approximately the same number of negative ions are required in every case in order to react optimally with the fixed number of positive ions.

Figure 8:
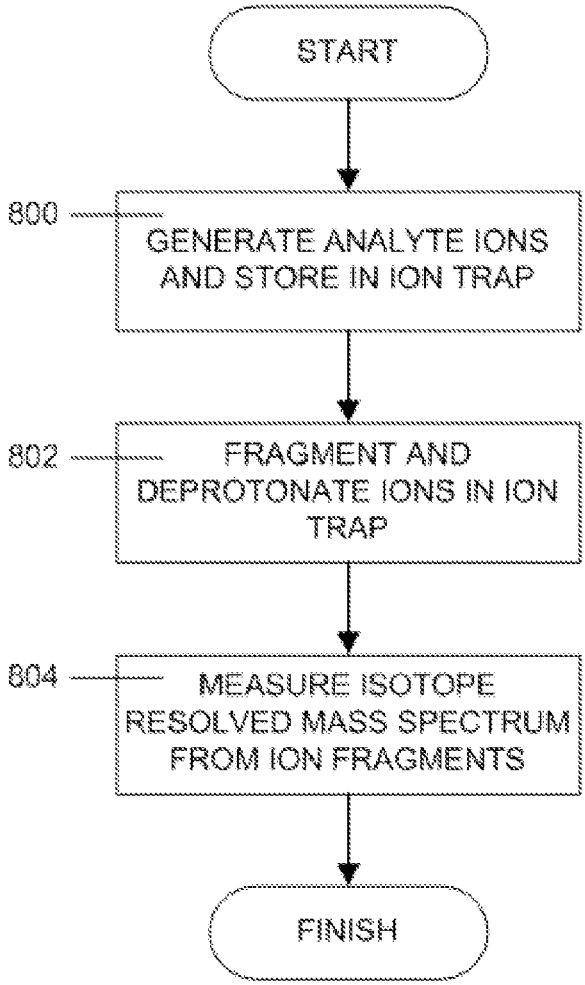
FIG. 8 is a flowchart illustrating the steps in an illustrative process for generating an isotope resolved mass spectrum from highly charged analyte ions.

The method according to the invention for obtaining fragment ion spectra for proteins and large protein fragments, demonstrating a wide sequence coverage, in mass spectrometers that are equipped with ion traps, is illustrated in the flowchart shown in FIG. 8 and can comprise the following steps:

a) (800) generating highly charged analyte ions of the proteins, and storing a quantity of such analyte ions in the ion trap of the mass spectrometer, b) (802) introducing such quantities of radical anions for electron transfer dissociation and such quantities of non-radical anions for deprotonation that a mixture of fragment ions is created consisting of ions with charge levels from one to n, with a selectable maximum charge level n in the range from $3 \leqq n \leqq 8$, and c) (804) measuring an isotope-resolved mass spectrum from these reduced-charge fragment ions.

In step b) the deprotonation of the analyte ions can precede their fragmentation, or it is possible for fragmentation to precede deprotonation of the fragment ions created in this way.

The generation of the ions in step a) is preferably achieved by electrospraying, as this generates multiply charged ions as are required for electron transfer dissociation. This means, however, that high-molecular substances will inevitably give rise to analyte ions with a high number of charges, and these, in turn, will yield fragment ions with a high number of charges. Instead of electrospraying, other methods of ionization can be used if these generate multiply charged ions such as, for instance, ionization of surface-bound analyte samples by bombardment with highly charged molecule clusters. Here again, ions with a high number of charges are generated from large biomolecules.

For the fragmentation in step b) it is not necessary for all the analyte ions of the various charge levels to be stored; it is also possible, by known means, for analyte ions of a single charge level to be isolated, or for the analyte ions to be deprotonated down to a preselected level of charge. It is also possible for analyte ions consisting of a mixture of several charge levels to be fragmented together. In every case, however, the isotope pattern of the selected analyte ions must be fully preserved when isolating the parent ions, so that the level of charge of the fragment ions can be read from the isotope pattern, and so that it is possible to calculate the monoisotopic form.

The fragmentation in step b) can be implemented by electron transfer (ETD), by electron capture dissociation (ECD), by radiation with infrared photons (IRMPD) or by reactions with highly excited, metastable neutral particles (MAID="metastable atom induced decomposition"). Fragmentation by collisions (CID) following resonant excitation of the secular oscillations of the analyte ions require special measures in order to achieve collisions of sufficient energy.

If the fragmentation in step b) is carried out with the aid of electron transfer dissociation by electron attachment to suitable reactant substances, a variety of different reactant substances can be used to produce the necessary radical anions, such as fluoranthene, fluorenone, anthracene or other polyaromatic compounds. It is also, in principle, possible to use a mixture of reactant substances.

The transfer of a preselected quantity of radical anions into the ion trap can also be combined with the selection of specific ions if these were, for instance, created from a mixture of substances, and only one type of ion from the resulting mixture of ions is to be used for the electron transfer dissociation. Non-radical anions added to the mixture can also be filtered out here. This filtering can, for instance, be implemented with a quadruple filter mounted between the electron attachment ion source and the ion trap. Unwanted ions can, however, also be removed at the storage stage, for instance by means of resonant excitation of their secular oscillation frequency to prevent them from being stored.

In order to accelerate the electron transfer dissociation, an excess of radical anions can be deliberately introduced into the ion trap. In this case, it is possible to remove the excess radical anions from the ion trap after a preselected reaction time has elapsed in order to prevent the occurrence of a large number of electron transfer dissociations of multiply charged fragment ions once a large number of fragment ions have been formed. This would create what are known as "internal fragments", making the interpretation of the fragment ion spectra more difficult. It is therefore necessary to stop the electron transfer dissociation reactions after a preselected reaction time by removing the radical anions. The reaction time should be selected so that a certain percentage of fragmented parent ions is not exceeded, 30 or 70 percent, for instance.

The radical anions can be removed from the ion trap by a variety of known methods, for instance by resonant ejection, which is preferably used here. It is also, however, possible to remove the radical anions by changing the RF voltage at the ion trap, so creating conditions under which the storage of the radical anions is unstable, as a result of which they leave the ion trap. The last method is, however, only possible if there are no fragment ions of interest in the ion trap which are lighter than the radical anions.

In order to create the negative ions for deprotonation, the same ion source can be used as for the generation of the radical anions. The non-radical anions for deprotonation can, however, be produced in independent ion sources, or even in an electrospray ion source similar to the one which creates the analyte ions. A second spray capillary (2*b*) can, for instance, be used here. In any event, the spray voltages here are reversed in order to create negative ions and guide them to the inlet capillary into the mass spectrometer's vacuum system. It is also possible to set up negative chemical ionization by corona discharge or other methods.

For the non-radical anions used for deprotonation, it is again expedient to store a preselected quantity in the ion trap so that the deprotonation process can occur. If the desired low-charge analyte or fragment ions are almost all that is left in the ion trap, but not all the non-radical anions have been consumed, then it is necessary (usually after a preselected reaction time has elapsed) to remove the remaining non-radical anions. Here too, the anions are preferably ejected from the ion trap by resonant excitation of their secular oscillations.

After step b) it can also be favorable to remove some of the remaining parent ions, which are also now present with reduced levels of charge, and which still represent by far the largest proportion of the contents of the ion trap. This increases the dynamic measuring range of the ion trap, and the spectrum of fragment ions emerges more clearly. The loss of ions in the ion trap can again here be compensated for by initially overfilling the ion trap with analyte ions.

Any person of ordinary skill having knowledge of this invention will also be able to set up modified procedures or improvements of the method disclosed here. All such solutions are included in the idea of the invention.

What is claimed is:

1. A method for the creation of fragment ion spectra from highly charged protein ions contained in an ion trap of a mass spectrometer, comprising:

(a) fragmenting ions in the ion trap and introducing non-radical anions into the ion trap to partially deprotonate ions in the ion trap so that fragment ions having between one and n charges are generated, where $3 \leqq n \leqq 8$; and (b) recording a mass spectrum of the fragment ions with a mass analyzer that can mass resolve an isotope pattern of the fragment ions.

2. The method according to claim 1, wherein, in step (a), partial deprotonation of the highly charged protein ions is performed prior to fragmentation.

3. The method according to claim 2, wherein, in step (a), partial deprotonation prior to fragmentation is halted at a charge level k by resonantly exciting ions having that charge level.

4. The method according to claim 3, wherein, in step (a), the partial deprotonation down to a charge level k is carried out in two or more stages.

5. The method according to claim 3, wherein the ion trap is an 2D or 3D RF ion trap.

6. The method according to claim 5, wherein, in step (a), fragmentation of protein ions having a charge level k is performed by collision-induced dissociation that occurs after exciting at least one of secular and forced oscillations of the protein ions during an excitation phase.

7. The method according to claim 1, wherein, in step (a), prior to the collision-induced dissociation, an RF voltage of the RF ion trap is set to a predetermined increased level in order to achieve high-energy collisions during the excitation phase, and the RF voltage is lowered after the excitation phase, so that light fragment ions can be stored in the ion trap.

8. The method according to claim 1, wherein, in step (a), fragmentation is performed by infrared multiphoton dissociation.

9. The method according to claim 1, wherein, in step (a), fragmentation is performed by one of electron transfer dissociation, electron capture dissociation and electron transfer from neutral, highly excited atoms or molecules.

10. The method according to claim 9, wherein, in step (a), electron transfer dissociation is produced by introducing into the ion trap radical anions that are produced in an electron attachment ion source.

11. The method according to claim 1, wherein, in step (a), non-radical anions for deprotonation are generated in an electron attachment ion source.

12. The method according to claim 1, wherein, in step (a), non-radical anions for deprotonation are generated in an electrospray ion source.

13. The method according to claim 1, wherein the highly charged protein ions are generated in an electrospray ion source.

14. The method according to claim 1, further comprising calculating from the isotope-resolved fragment ion spectrum recorded in step (b), a virtual mass spectrum of the fragment ions, containing only the data for singly charged, monoisotopic signals.

15. The method according to claim 1, wherein step (b) comprises recording the mass spectrum using an RF ion trap which serves as a mass analyzer.

16. The method according to claim 1, wherein step (b) comprises recording the mass spectrum using a mass analyzer that is coupled to the ion trap.

17. The method according to claim 1, wherein, at least some highly charged protein ions remaining in the ion trap after step (a) are removed by means of resonant excitation.

18. A method for the creation of fragment ion spectra from highly charged protein ions in mass spectrometers with ion traps, comprising the steps:

a) generating the highly charged analyte ions of the proteins, and storing a predetermined quantity of the generated analyte ions in the ion trap of the mass spectrometer, b) introducing radical anions to produce electron transfer dissociation and non-radical anions to produce partial deprotonation into the ion trap so that a mixture of fragment ions is created consisting of ions with charge levels essentially from one to n only, with a selectable maximum charge level n in the range from $3 \leqq n \leqq 8$, and c) measuring a mass spectrum from the fragment ions.

* * * * *